US005149086A

United States Patent [19]

Ziff

[11] Patent Number: 5,149,086

[45] Date of Patent: Sep. 22, 1992

[54] POOLSIDE BASKETBALL GAME

[76] Inventor: Irving Ziff, 333-B W. Alondra Blvd., Gardena, Calif. 90248

[21] Appl. No.: 739,463

[22] Filed: Aug. 2, 1991

[51] Int. Cl.[5] ..... A63B 63/08

[52] U.S. Cl. ..... 273/15 R

[58] Field of Search ..... 273/1.5 R, 411

[56] References Cited

U.S. PATENT DOCUMENTS 3,582,078 6/1971 Katras ..... 273/1.5 R X
4,145,044 3/1979 Wilson et al. ..... 273/1.5 R
4,307,887 12/1981 Weiss ..... 273/1.5 R X
4,762,319 8/1988 Krumholz ..... 273/1.5 R
4,786,053 11/1988 Barnes, Jr. ..... 273/1.5 R
4,974,841 12/1990 Jarriel et al. ..... 273/1.5 R

*Primary Examiner*—Paul E. Shapiro

[57] ABSTRACT

A poolside basketball game comprised of a portable backboard assembly, a basketball hoop assembly, and a basketball, contained in a kit form whereby the purchaser can easily mount, support, adjust, adapt, fit, assemble, and erect the component parts of the kit at the pool site on the pool rail of any size and width substantially without the use of tools.

5 Claims, 1 Drawing Sheet

POOLSIDE BASKETBALL GAME

BACKGROUND OF THE INVENTION

1. Field of the Invention

The present invention relates to poolside games and, more specifically, to a poolside basket ball game for children and/or adults which can be played from an above-ground swimming pool. The component parts of the equipment for this game are provided in kit form and can be easily assembled and erected by the purchaser at and upon the pool site ground or foundation. An easily adjustable hook and adjustable straps yieldably for play, but with optimum stability, securing the game anywhere along the top rail of the pool.

2. Background of the Invention

One of the most popular athletic sports in the United States is the game of basketball. This sport has heretofore been adapted for play in below-ground swimming pools with their surrounding ground level decks. The basketball hoop with its backboard can be permanently attached to a conventional post on the pool deck adjacent to the pool. However, such attachment to an above-ground portable type of swimming pool has not been found feasible in an above-ground pool.

Accordingly, it is an object of the present invention to provide a swimming pool basketball game which can be attached to the coping or top rail of an above-ground portable swimming pool with walls as high as four feet or more.

Another object of the invention is to provide a complete set of component parts for the easy assembly of the equipment required for the game substantially without the use of tools.

A further object of the invention is to provide an improved, versatile, simple, sturdy, convenient means for readily removable and adjustable attaching of the equipment along the top rial of a portable swimming pool.

Preferably, these and other objects are achieved by providing all the component parts of a swimming pool basketball game compactly packed for commercial sale as in a carton, facilitating its transport to the playing site, and its easy assembly and erection a&: the site.

Other objects and advantages of the invention will become apparent from the following summary and detailed description of the preferred embodiment of the invention taken in conjunction with the accompanying drawing figures.

SUMMARY OF THE INVENTION

The present invention comprises the assembly and support of the parts required for the game of poolside basketball, which can be assembled at, mounted on, and played in above-ground swimming pools. The equipment includes a rebound backboard assembled from plastic pipe, preferably P.V.C., and fittings forming rectangular framework whereon a nylon cord net and/or a hardboard panel is attached. A basketball hoop is affixed to said framework and the assembled backboard is secured to the top rail o the portable above-ground swimming pool by means of simple and versatile adjustable buckle straps and hooks This means of poolside assembly and attachment to the pool wall minimizes the use of hand tools and simplifies the assembly and installation of the need sports equipment.

DETAILED DESCRIPTION OF THE PREFERRED EMBODIMENT

Figure 1:
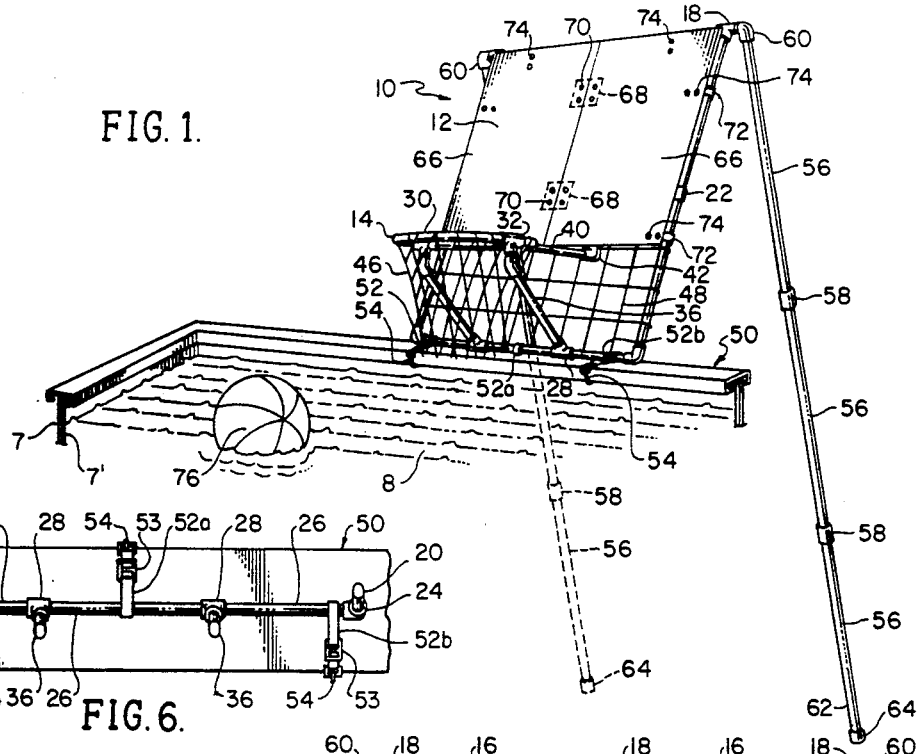
FIG. 1 is a perspective view of the basketball backboard and basket as attached to the rail of an above-ground swimming pool.
Figure 6:
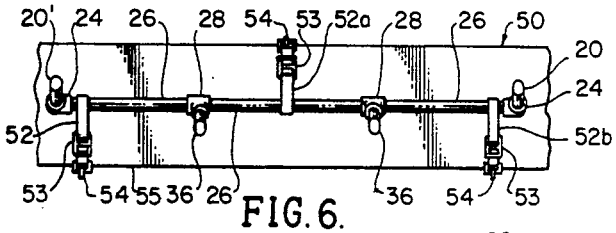
FIG. 6 is a plane view looking downwardly in a horizontal plane along a line 6—6 of FIG. 3.

Referring initially to FIG. 1, there is illustrated a detailed best form of the invention packaged for successful marketing. The items of equipment generally identified as 10, can be then assembled to play basketball in the above-ground swimming pool. The component parts of the backboard 12 and its attached basket 1 preferably comprise white P.V.C. Schedule 40 pipe and fittings which are originally packed unassembled as a kit in a carton, with explicit assembly instructions for the purchaser.

Figure 2:
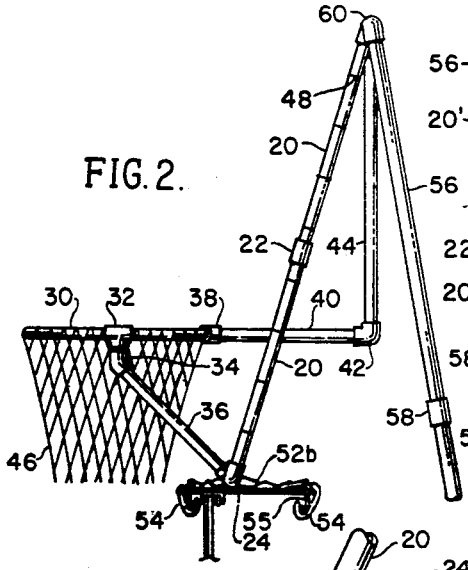
FIG. 2 is a side elevational view of the basketball equipment shown in FIG. 1.
Figure 3:
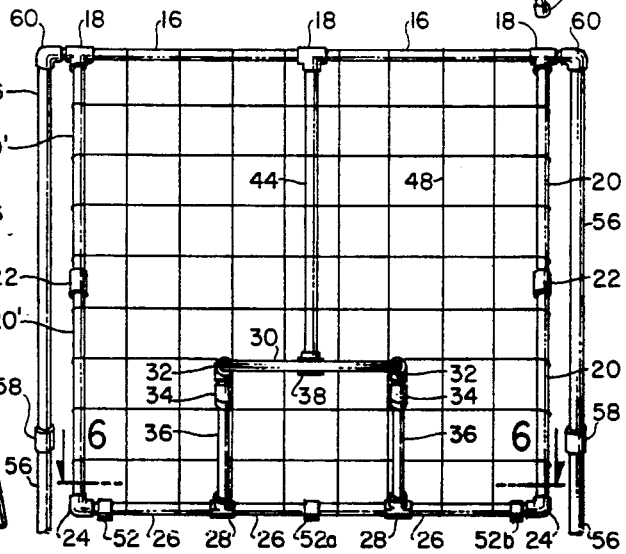
FIG. 3 is a front elevational view of the framework of the backboard and the basket hoop without the basket netting.

As shown in FIGS. 2 and 3, the framework of the backboard 12 comprises two top sections of pipe 16 inserted in three tees 18. Four upright sections of pipe 20 and 20' are coupled together with connectors 22 and terminate in 90 degree elbows 24 at their lower ends. The bottom member of the framework comprises three sections of pipe 26 interconnected with two tees 28.

The hoop 30 is provided with two diametrically opposite tees 32 extending downwardly into two 45 elbows 34 which are connected by pipe sections 36 to the tees 28 in the bottom member of the backboard framework. The hoop 30 is additionally braced into the backboard framework by a tee 38, midway on its periphery between the tees 32, pipe section 40 connected to 90 degree elbow 42, and pipe section 44 which terminates into tee 18 in the top member of the framework (see FIG. 3).

All pipes and fittings in the form shown are bonded together with P.V.C. cement. Finally, the netting 46 is attached to the hoop 30 and the nylon cord gridwork net 48 is affixed to the assembled backboard framework.

The hoop and backboard assembly is attached to the top rail 50 of the above-ground swimming pool by means of three buckle straps 52 and hooks 54. Two buckle straps and hooks are positioned at the outward extremities of the bottom member of the framework with the hooks 54 engaging the rail edge 55 toward the inside of the pool. The third strap 52 is located midway on the bottom member with the hook 54 engaging the outside edge of the pool rail 50. The straps are adjustable to facilitate the attachment of the backboard framework to various widths of pool rails.

To provide needed impact support to the upper portion of the backboard framework, pipe sections 56, interconnected by couplings 58, are inserted in 90 degree elbows 60 extending from the top member of the framework (see FIGS. 1 and 3). The lower ends 62 of the two pipe braces are provided with caps 64 which may be made of rubber or equipped with spike projections thereon (not shown). In order to set the hoop 30 in a horizontal position, two of the lower pipe sections 56 may be cut to the proper length to accommodate the various wall heights of the portable pool.

Figure 5:
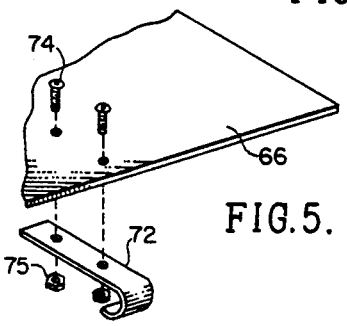
FIG. 5 is a partial perspective view showing the clamp and its mean of attachment to the edge of the backboard panel.

The basketball game may be played with only the nylon grid net 48 attached to the backboard framework or with tempered hardboard backstop panels 66 attached thereon (see FIG. 1). Two half panels 66 are joined together by connector plates 68 deposed on the back of the panels 66 and attached thereon by means of screws and nuts 70. This assembled backstop panel is then securely clamped to the backboard framework by means of stainless steel clamps 72, as shown in FIG. 5. Six clamps 72, two on each side, attached to three sides of the backboard panel 66 by means of bolts 74 and nuts 75.

Improved means of securement of the equipment 10 to the swimming pool top rail 50 is employed. In particular, as noted, the top rails of the pool commercially available varies widely from a narrow coping to a wide top rail as illustrated, for example, in FIG. 4, and now commercially available from a simple curved cap to a rail approximately 10" wide.

To accommodate the needs of proper mean of securement of the equipment to the top rail coping 50 of any width, buckle straps 52 are employed. These comprise a strap portion preferably of polypropylene approximately an inch in width and approximately one-sixteenth inches in thickness.

Figure 4:
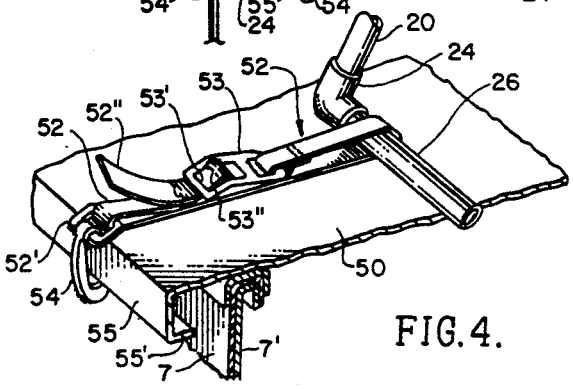
FIG. 4 is a partial perspective view of the strap and hook used in attaching the bottom member of the backboard frame to the rail of the swimming pool.

The strap is secured to the buckle at one end as illustrated in FIG. 4. The other end 52 of the strap is first trained over the bottom pipe member 26. Thence to the left as illustrated in FIG. 4 and up through an eyelet 52'. Then reversing itself toward the right after being trained up through the eyelet. The strap re-enters the buckle and passes under a lip guide 53' integral with the buckle and thence farther to the left a illustrated in FIG. 4 to turn under a suitable buckle pin 53" illustrated in dotted lines, thence trained and pulled through the buckle to end at 52". The eyelet 52" is secured to a hook 54 illustrated in FIGS. 1 and 2, which releasably engages a flange defining an outer rail edge 55 terminating in an inwardly turned flange 55' thereunder.

Similar such belt-and-buckle securements are advantageously provided in at least three locations. Two, 52 and **52*b* are respectively positioned at the opposite outer edges, inwardly of and preferably similarly adjacent the opposite pipes 20 and 20'. The strap 52*a* is secured centrally around the pipe 26 and flanges 55, 55". The strap 52*a* is fastened, secured, and tightened in an opposite direction in the center to counter-pull against the outer buckle straps 52 and 52*b***. Thereby the equipment is held in a triangular fixity of position, preventing undesired pivoting, and serving the needs of a stable, versatile, facile, desired securement over a wide range of top rails and the like.

It is to be noted that the present inventive concept of this poolside basketball game is easily assembled by the purchaser from a collection of individual component parts whose configuration and size permit their placement in a display container or kit suitable for point-of-sale display and/or transportation from the place of purchase. An inflatable ball 76 is included in the kit.

A preferred embodiment of the present best mode of the invention has been shown and described. It will be obvious to those skilled in the art that changes and modifications by equivalents ma be made without departing from the invention aspects and, therefore, the aim in the appended claims is to cover all such changes, modifications, and equivalents within the scope of the invention, its merchandizing, and operative utility and appeal.

I claim:

1. The combination of an assembly of component means for assembling a poolside basketball game having the capability for attachment to various sizes of pools and widths of top rails of above-ground swimming pools, and the means comprising:

a) a basketball hoop means for providing a target for a basketball, with integral supporting brace means for providing support for the hoop means;

b) a backboard framework means for supporting a backboard, and a cord net attached around the hoop, c) a second backstop means for providing a backstop comprising a hard reboundive panel;

d) an attachment means for rigidly securing said hoop means and backboard means to the top rail of an above-ground swimming pool; and e) an adjustable rearwardly deposed bracing means for bracing, supporting, and stabilizing the backboard means on the backside thereof.

2. The combination of claim 1, said attachment means comprising three buckle strap means for securing the game to the top rail, including hooks on the buckle strap means for engaging and holding the top rail and the backboard frame means, said buckle strap means being constructed and arranged for triangular fixity of position and support of said game relative to the pool top rail.

3. The combination of claim 2, said buckle strap means comprising belts and buckles adjustable to accommodate the top rails of pools of varying sizes.

4. The combination of claim 3, including polypropylene portions of said belts.

5. The combination of claim 3, including a basketball, said assembly arranged and adapted in disassembled relationship in kit form to be assembled and erected substantially without the use of tools.

* * * * *